United States Patent [19]

Knierim

[11] 4,280,683

[45] Jul. 28, 1981

[54] UTILITY PULLER

[75] Inventor: Larry Knierim, Blissfield, Mich.

[73] Assignee: Dana Corporation, Toledo, Ohio

[21] Appl. No.: 59,668

[22] Filed: Jul. 23, 1979

[51] Int. Cl.[3] ..... B66F 3/00; B66F 15/00

[52] U.S. Cl. ..... 254/17

[58] Field of Search ..... 254/11, 15–17, 254/77, 113, 120, 131, 132, 62

[56] References Cited

U.S. PATENT DOCUMENTS

| | | | |
|---|---|---|---|
| 382,295 | 5/1888 | Dey | 254/62 |
| 607,567 | 7/1898 | Jordan | 254/17 |
| 917,879 | 4/1909 | Linn | 254/77 |
| 1,317,145 | 9/1919 | Skantz | 254/77 |
| 2,370,333 | 2/1945 | Thompson | 254/77 |
| 2,996,283 | 8/1961 | Johnson | 254/77 |
| 3,049,336 | 8/1962 | Proffit | 254/17 |
| 3,779,515 | 12/1973 | Larios et al. | 254/16 |

*Primary Examiner*—Robert C. Watson

*Attorney, Agent, or Firm*—James F. Porcello

[57] ABSTRACT

This invention is a utility construction tool for providing controlled amounts of force to a work-object by means of lever action. Specifically, the invention is a lever arm handle with a hooking device attached. A force applied to the lever arm handle will in turn apply a concomitant force to the end of the hooking device.

5 Claims, 4 Drawing Figures

UTILITY PULLER

BACKGROUND OF THE INVENTION

The construction art and, in particular the pole building art, provides many instances where the application of controlled and directed force is necessary. For example, in the construction of pole buildings 2×8 planks tongue and grooved and are joined together in formation of the walls It is not uncommon for the planks to be warped longitudinally, making complete joinder of the tongue and groove joints very difficult. Thus, when faced with the warpage, it is common to use manpower to straighten the planks, align the tongue and grooving, and form the completed joint. This is accomplished by pounding the top of the plank with heavy objects until the tongue and grooving mates. Such procedure causes unnecessary hardship and risk as workmen must work at the top of the uncompleted wall while pounding the joints together. Such pounding with heavy objects also causes a substantial risk of damage to the planks and the tongue and grooving edges. The same problems encountered in the construction of pole buildings are also experienced in other building such as setting floor joists, aligning heavy flooring pieces, adjusting poles or wall studs, pulling 4×8 sheets of tongue and grooved plywood in office or house construction, and any other work involving the directed alignment of heavy construction materials.

Accordingly, it is an object of this invention to provide a utility construction tool capable of producing the forces needed for predetermined directional alignment of a work object with minimal worker exertion, labor hours and risk.

A further object of this invention is to provide a utility construction tool capable of furnishing the needed force for directional alignment of the work object while inflicting little or no damage to the work object.

SUMMARY OF THE INVENTION

The invention is an apparatus for use as a utility construction tool which has a lever arm handle with a foot attached to one end. The foot acts as a device which will anchor the lever arm handle to a fixed object. The hook element is separated from the lever arm handle and is used to engage a specified work object. In the preferred embodiment of this invention the hook element is attached to the lever arm handle by a chain. The point of attachment of the chain to the lever arm handle in the preferred embodiment is approximately 6¾ inches from the edge of the foot to allow the maximum leverage with the minium of damage to the material used in said construction.

and

Figure 4:
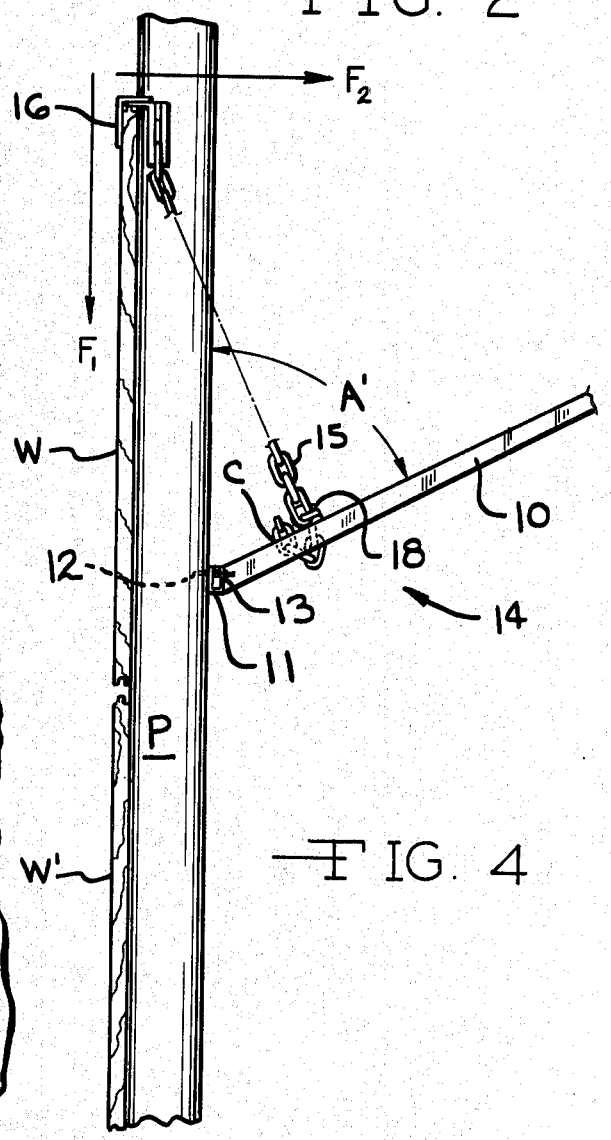

FIG. 4 is a side elevational view of the utility construction tool with all elements in the operating position.

Figure 1:
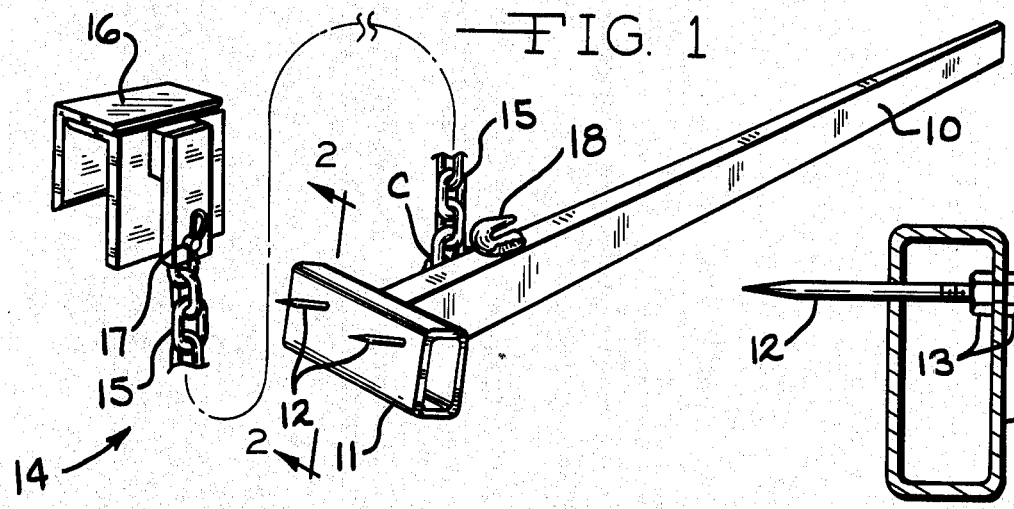
FIG. 1 is a perspective view of the utility construction tool according to the present invention.
Figure 2:
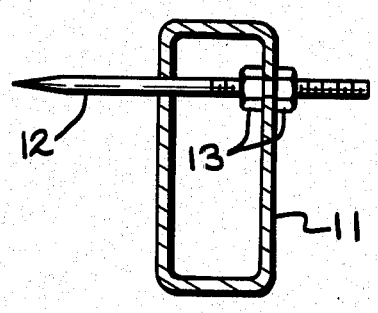
FIG. 2 is a detailed side view of the foot element and adjustable pikes as described in the present invention.

The utility construction tool shown generally in FIG. 1 includes a lever arm handle hollow to minimize the weight but not the strength 10 with a foot 11 attached to one end. The foot 11 is hollow and has two pikes 12 adjustably attached thereto, as shown in FIG. 2. The pikes 12 are pointed on the end extending from the base of the foot 11 while threaded at the opposing end. The threading allows for standard hexagonal nuts 13 to be used to attach the pikes 12 to the foot 11 and also to adjust the length and allow replacement of the pikes 12. In order to facilitate better leverage, the foot 11 is attached to the lever arm handle 10 to define an angle A′ between the foot and the handle which is less than 90°. In the preferred embodiment of the invention, as shown in the drawings, the acute angle A′ between the handle 10 and the foot 11 is 20°.

The other major component of the utility construction tool is the hook-up device 14 which is connected to the lever arm handle 10. The hook-up device 14 includes a chain 15 and a hook element 16 as shown in FIG. 1. One end of the chain 15 is permanently connected to the lever arm handle 10. In the preferred embodiment of this invention, the chain 15 is connected to the lever arm handle 10 at a point spaced a distance from the foot 11 which is approximately equal to one-fifth the length of the chain 15. The free end of the chain 15 is connected to the hook element 16 by means of a removable pin 17. In the preferred embodiment of this invention, the hook element 16 consists of two right angle iron elements welded together. It is to be understood that the chain 15 could also comprise a rigid metal rod hinged to the lever arm handle 10 and the hook element 16. The chain could also comprise a flexible cable.

The preferred embodiment of this invention also provides a grab hook 18 fixed to the lever arm handle 10 in close proximity to the attached chain 15 of the hook up device 14. Links of the chain 15 may be attached to the grab hook 18 to facilitate adjustment of desired leverage and strengthen the pulling forces at the hook element 16. The chain 15 may also be shortened by attaching a selected area of the chain 15 to the grab hook 18 when operating the invention as described below.

Figure 3:
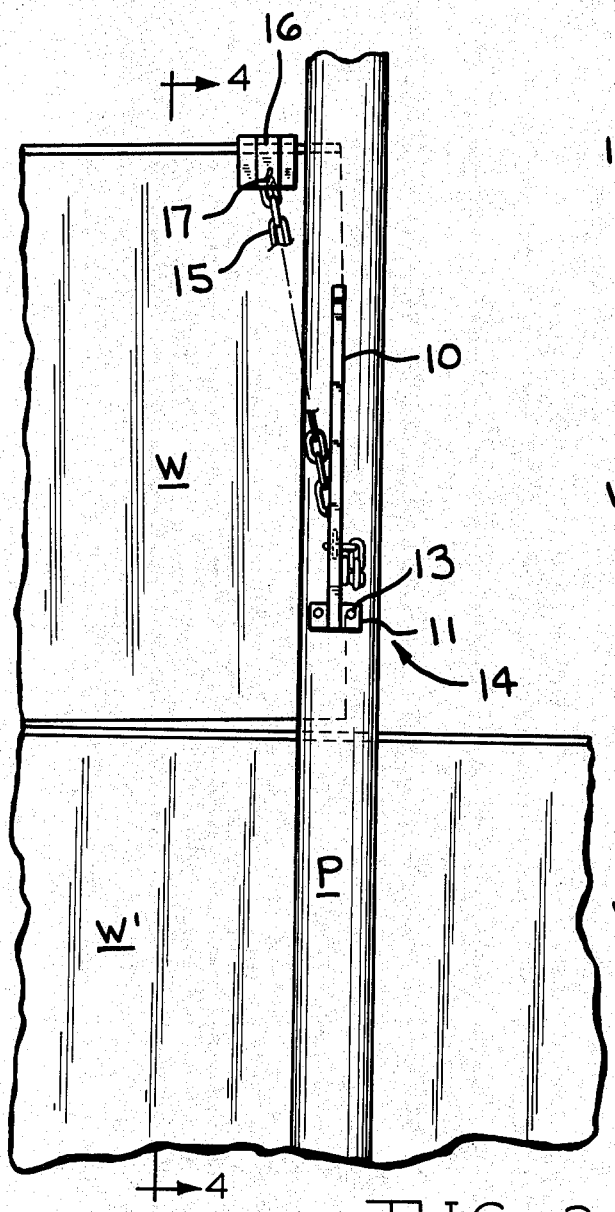
FIG. 3 is a front elevation view of the utility construction tool with all elements in the operating position.

FIGS. 3 and 4 show the position of the various components of the utility construction tool when operating. The hook element 16 is placed on the work object W intended to be aligned and moved. The chain 15 is then drawn taut. The foot 11 is placed against the fixed object such as a support pole P, resulting in forcing the pikes 12 to puncture the surface of the fixed object P, thereby giving the lever arm handle 10 a firm mounting on the fixed object P. It has been found that the chain 15 and grab hook 18 must be anchored to a point on the lever arm handle 10 so that a force applied to the lever arm handle 10 will achieve leverage applied to the work object W by means of two force components as graphically illustrated in FIG. 4.

The first component F1 is the major force component and applies force to the work object W in a direction away from the hook element 16 and toward the foot 11. The second component F2 is a minor force component and applies a force to the work object W in a direction perpendicular to force F1. These force components are most ideally achieved by locating the chain 15 and grab hook 18 at a point on the lever arm handle 10 spaced a distance from the foot 11 which is equal to approximately 1/5 the length of the chain 15. These two force components F1 and F2 tend to pull the work object W into a joined relationship with a second work object W1 as shown in FIG. 4 and at the same time pull the work object W tightly against the support pole P.

In this manner the work object W, such as the tongue and groove plywood sheet W is pulled into engagement with the mating tongue and groove plywood sheet W1 and at the same time pulled against pole P for attachment thereto.

It can be appreciated that the lever arm handle 10 must extend a sufficient distance from the foot 11 in order to achieve substantial leverage against the work object to apply substantial force F1 and F2 to the work object W through the hook element 16. For example, in the preferred embodiment of the invention, the lever arm handle 10 is 32 inches in length, the chain 15 is three feet long and the distance between the foot 11 and the chain connection point C and the grab hook 18 is between 6 and 7 inches. Depending on the weight of the operator, the force components F1 and F2 will range in the order of magnitude of 500 to 1000 pounds.

The utility construction tool thus described facilitates the application of substantial force to the work object W from a position remote from the object. This is particularly significant in the alignment of vertical walls wherein the worker may apply force to the work object while standing in a safe place.

It is understood that the above-description of the present invention may be embodied in other forms without departing from the spirit and essential scope of the following claims.

I claim:

1. An apparatus for use as a utility construction tool comprising a lever arm handle, a grab hook positioned on said lever arm handle, means for anchoring one end of said lever arm handle, said anchoring means including a foot, said foot being substantially wider than said lever arm, said foot including a plurality of adjustable and replaceable pikes extending from the surface of said foot which opposes said lever arm handle, said adjustable pikes being pointed at the end extending from said foot and threaded at the opposing end so as to enable said pikes to be adjustable and replaceable, a work object engaging means separate from said lever arm handle, means for removably connecting said lever arm handle to said work engaging means, said connecting means being fixed to said lever arm handle at a point spaced from said foot and substantially adjacent said grab hook; whereby application of force at said lever handle will pivot said lever arm handle on said anchoring means in a direction away from said work engaging means and produce a concomitant force at said work engaging means in the direction of said connecting means.

2. A utility construction tool as described in claim 1 wherein the angle defined between said foot and said lever arm handle is approximately 20°.

3. A utility construction tool as described in claim 1 wherein said connection means can be shortened by attaching a selected length of said connecting means to said grab hook.

4. A utility construction tool as described in claim 1 wherein said connecting means is attached to said lever arm handle at a point spaced from said foot by a distance substantially equal to one-fifth the length of said connecting means.

5. An apparatus for use as a utility construction took comprising a lever arm handle with a grab hook located $6\frac{3}{4}$ inches from a first end of said lever arm handle; a foot fixed at a 20° angle to said first end of said lever arm handle, said foot being 3 times the width of said lever arm handle, said foot also containing two adjustable pikes extending from the surface of said foot which opposes said lever arm handle, said adjustable pikes being pointed at the end extending from said foot and threaded at the opposing end so as to enable said adjustable pikes to be adjustable and replaceable; a hook-like element consisting of two right angle irons permanently welded together and connected by removable means to a chain, the opposing end of said chain being permanently fixed to said lever arm handle in close proximity to said grab hook, whereby the application of force at said lever arm handle will pivot said lever arm handle on said foot away from said hook-like element and produce a concomitant force at said hook-like element in the direction of said chain.

* * * * *

UNITED STATES PATENT AND TRADEMARK OFFICE

CERTIFICATE OF CORRECTION

PATENT NO. :4,280,683

DATED :July 28, 1981

INVENTOR(S) :Larry Knierim

It is certified that error appears in the above—identified patent and that said Letters Patent is hereby corrected as shown below:

Column 1, line 24, after "building" insert -- trade --.

Claim 5, line 1, "took" should read -- tool --.

Signed and Sealed this

*Sixteenth* Day of *February 1982*

[SEAL]

*Attest:*

GERALD J. MOSSINGHOFF

*Attesting Officer*

*Commissioner of Patents and Trademarks*